US012163305B1

(12) United States Patent
Li et al.

(10) Patent No.: US 12,163,305 B1
(45) Date of Patent: Dec. 10, 2024

(54) INSTALLATION METHOD FOR CLOSURE JOINT OF IMMERSED TUNNEL

(71) Applicants: CCCC FIRST HARBOR ENGINEERING CO., LTD., Tianjin (CN); NO. 2 ENGINEERING COMPANY LTD. OF CCCC FIRST HARBOR ENGINEERING COMPANY LTD., Qingdao (CN)

(72) Inventors: Yiyong Li, Tianjin (CN); Naishou Zhang, Tianjin (CN); Yipin Cheng, Tianjin (CN); Chao Zhang, Tianjin (CN); Xuhong Suo, Tianjin (CN); Zhanwei Han, Tianjin (CN); Zhenjie Tao, Tianjin (CN); Yongshuai Zhu, Tianjin (CN); Bo Yu, Tianjin (CN); Chuang Du, Tianjin (CN)

(73) Assignees: CCCC FIRST HARBOR ENGINEERING CO., LTD., Tianjin (CN); NO. 2 ENGINEERING COMPANY LTD. OF CCCC FIRST HARBOR ENGINEERING COMPANY LTD., Qingdao (CN)

( * ) Notice: Subject to any disclaimer, the term of this patent is extended or adjusted under 35 U.S.C. 154(b) by 0 days.

(21) Appl. No.: 18/801,756

(22) Filed: Aug. 12, 2024

Related U.S. Application Data

(63) Continuation of application No. PCT/CN2023/117659, filed on Sep. 8, 2023.

(30) Foreign Application Priority Data

Jul. 26, 2023 (CN) ..... 202310921919.3

(51) Int. Cl.
*E02D 29/045* (2006.01)
*E02D 29/073* (2006.01)
*E02D 29/16* (2006.01)

(52) U.S. Cl.
CPC ..... *E02D 29/073* (2013.01); *E02D 29/16* (2013.01)

(58) Field of Classification Search
CPC ... E02D 29/063; E02D 29/077; E02D 29/073; E02D 29/07; E02D 29/067; E02D 29/16
See application file for complete search history.

(56) References Cited

U.S. PATENT DOCUMENTS 3,750,411 A * 8/1973 Shimizu ..... E02D 25/00 277/616
3,901,038 A * 8/1975 Olsen ..... E02D 29/073 405/136

(Continued)

FOREIGN PATENT DOCUMENTS

CN 112541218 A 3/2021
CN 114439042 A 5/2022

(Continued)

OTHER PUBLICATIONS

International Search Report for PCT/CN2023/117659.
Search Report of the priority application CN202310921919.3.

*Primary Examiner* — Benjamin F Fiorello
(74) *Attorney, Agent, or Firm* — J.C. PATENTS

(57) ABSTRACT

The present application relates to an installation method for a closure joint of an immersed tunnel, and belongs to the technical field of closure joints; the installation method comprises the steps: establishing a first coordinate system; distributing feature points; installing the $N_{+2}$ tube coupling; installing an $N_{+1}$ tube coupling and pushing out a push-out segment; wherein, the first coordinate system is established at a tail end of an $N_{+3}$ tube coupling, breakthrough points (Continued)

$N_{+1}S$ and $N_{+1}W$ are distributed at a head end and a tail end of a $N_{+1}$ tube coupling respectively, breakthrough points DS and DW are distributed at a push-out segment, and breakthrough points $N_{+2}S$ and $N_{+2}W$ are distributed at a head end and a tail end of a $N_{+2}$ tube coupling respectively; and coordinates of the breakthrough points DS, DW, $N_{+1}S$, $N_{+1}W$, $N_{+2}S$, $N_{+2}W$ in the first coordinate system are calculated respectively; the installation method can improve the installation accuracy of the closure joint and is easy to operate.

11 Claims, 2 Drawing Sheets

(56) References Cited

U.S. PATENT DOCUMENTS

| | | | | |
|---|---|---|---|---|
| 4,468,155 | A * | 8/1984 | Levallois | G01S 15/872 166/341 |
| 5,540,522 | A * | 7/1996 | Launaro | E02D 29/067 52/167.1 |
| 5,899,635 | A * | 5/1999 | Kuja | E02D 29/067 405/134 |
| 11,136,740 | B1 * | 10/2021 | Du | E02D 29/067 |
| 2010/0310318 | A1 * | 12/2010 | Hertgers | E02D 29/063 405/134 |
| 2018/0274197 | A1 * | 9/2018 | Lin | E02D 29/073 |
| 2019/0063062 | A1 * | 2/2019 | Lin | E02D 29/073 |
| 2022/0098818 | A1 * | 3/2022 | Jin | E02D 29/067 |

FOREIGN PATENT DOCUMENTS

| | | | |
|---|---|---|---|
| CN | 115046537 | A | 9/2022 |
| CN | 115075296 | A | 9/2022 |
| CN | 115094952 | A | 9/2022 |
| CN | 115162409 | A | 10/2022 |
| CN | 116657649 | A | 8/2023 |
| JP | H09203060 | A | 8/1997 |
| JP | H09203061 | A | 8/1997 |
| JP | 2004325107 | A | 11/2004 |

* cited by examiner

INSTALLATION METHOD FOR CLOSURE JOINT OF IMMERSED TUNNEL

The present application is a continuation of international application PCT/CN2023/117659 filed on Sep. 8, 2023, which claims the priority of Chinese patent application No. 202310921919.3, filed to CNIPA on Jul. 26, 2023, and entitled "INSTALLATION METHOD FOR CLOSURE JOINT OF IMMERSED TUNNEL", the entire contents of the above identified applications are incorporated herein by reference.

TECHNICAL FIELD

The present application belongs to the technical field of closure joints, and particularly relates to an installation method for a closure joint of an immersed tunnel.

BACKGROUND

In order to shorten a construction period, an immersed tunnel is usually constructed simultaneously from both ends in a tunnel length direction, and finally a closure joint is used to connect tube couplings placed at both ends to achieve final closure of the tunnel. A mounting sequence of the tube couplings is shown in FIG. 1: a closure opening of the immersed tunnel is designed between an $N_{+1}$ tube coupling and an $N_{+2}$ tube coupling, where a push-out segment is disposed at a tail end of the $N_{+1}$ tube coupling. During construction, the $N_{+2}$ tube coupling is installed first, then the $N_{+1}$ tube coupling and the push-out segment are installed: after the $N_{+1}$ tube coupling and the push-out segment are immersed, the push-out segment is pushed out from the $N_{+1}$ tube coupling towards the $N_{+2}$ tube coupling, to butt with the $N_{+2}$ tube coupling, thereby completing the closure construction of the immersed tunnel.

Since the $N_{+1}$ tube coupling and the $N_{+2}$ tube coupling are constructed independently of each other, there may be a deviation between axes of the $N_{+1}$ tube coupling and the $N_{+2}$ tube coupling, which will affect the connection quality of the closure joint and cause serious consequences.

SUMMARY

To overcome the shortcomings in related arts, the present application provides an installation method for a closure joint of an immersed tunnel to improve the installing accuracy of the closure joint.

The present application provides an installation method for a closure joint of an immersed tunnel, which comprises:

establishing a first coordinate system: establishing the first coordinate system at a tail end of an installed $N_{+3}$ tube coupling;

distributing feature points: distributing breakthrough points $N_{+1}S$ and $N_{+1}W$ at a head end and a tail end of a $N_{+1}$ tube coupling respectively, distributing breakthrough points DS and DW at a push-out segment, and distributing breakthrough points $N_{+2}S$ and $N_{+2}W$ at a head end and a tail end of a $N_{+2}$ tube coupling respectively; and calculating coordinates of the breakthrough points DS, DW, $N_{+1}S$, $N_{+1}W$, $N_{+2}S$, $N_{+2}W$ in the first coordinate system respectively;

installing the $N_{+2}$ tube coupling: calculating a deviation between the $N_{+2}$ tube coupling and the $N_{+3}$ tube coupling by using the coordinates of the breakthrough points $N_{+2}S$ and $N_{+2}W$ in the first coordinate system, and adjusting an installing position of the $N_{+2}$ tube coupling to make the head end of the $N_{+2}$ tube coupling butt with the tail end of the $N_{+3}$ tube coupling;

installing an $N_{+1}$ tube coupling: butting the head end of the $N_{+1}$ tube coupling with a tail end of an installed N tube coupling: calculating a deviation between the $N_{+1}$ tube coupling and the $N_{+2}$ tube coupling by using the coordinates of the breakthrough points $N_{+1}S$ and $N_{+1}W$ in the first coordinate system, and adjusting an installing position of the $N_{+1}$ tube coupling to make the tail end of the $N_{+1}$ tube coupling close to the tail end of the $N_{+2}$ tube coupling;

pushing out a push-out segment: calculating a deviation between the push-out segment and the $N_{+1}$ tube coupling and a deviation between the push-out segment and the $N_{+2}$ tube coupling respectively by using the coordinates of the breakthrough point DS and/or DW in the first coordinate system, and adjusting a pushing-out direction of the push-out segment disposed inside the $N_{+1}$ tube coupling towards the $N_{+2}$ tube coupling, so as to allow the push-out segment to be precisely butted with the tail end of the $N_{+2}$ tube coupling;

in the step of distributing the feature points, distributing a control point $N_{+3}D$ at the tail end of the $N_{+3}$ tube coupling, by taking the control point $N_{+3}D$ as a reference point, measuring relative positions of the breakthrough points DS, DW, $N_{+1}S$, $N_{+1}W$, $N_{+2}S$, $N_{+2}W$ with respect to the control point $N_{+3}D$ respectively, and converting the relative positions into coordinates in the first coordinate system, where coordinates of the breakthrough point $N_{+3}D$ in the first coordinate system are (x0, y0, z0), coordinates of the breakthrough point DW in the first coordinate system are (x1, y1, z1), coordinates of the breakthrough point DS in the first coordinate system are (x2, y2, z2), coordinates of the breakthrough point $N_{+1}S$ in the first coordinate system are (x3, y3, z3), coordinates of the breakthrough point $N_{+1}W$ in the first coordinate system are (x4, y4, z4), coordinates of the breakthrough point $N_{+2}S$ in the first coordinate system are (x5, y5, z5) and coordinates of the breakthrough point $N_{+2}W$ in the first coordinate system are (x6, y6, z6);

in the step of pushing out the push-out segment, a method for calculating the deviation between the push-out segment and the $N_{+2}$ tube coupling is as follows:

$$\Delta x_3 = x1 - \frac{x5 + x6}{2};$$

$$\Delta y_3 = y1 - \frac{y5 + y6}{2};$$

$$\Delta z_3 = z1 - \frac{z5 + z6}{2};$$

where, $\Delta x_3$ is a deviation between the push-out segment and the $N_{+2}$ tube coupling in the x-axis direction: $\Delta y_3$ is a deviation between the push-out segment and the $N_{+2}$ tube coupling in the y-axis direction; and $\Delta z_3$ is a deviation between the push-out segment and the $N_{+2}$ tube coupling in the z-axis direction;

a method for calculating the deviation between the push-out segment and the $N_{+1}$ tube coupling is as follows:

$$\Delta x_4 = x2 - \frac{x3 + x4}{2};$$

-continued $$\Delta y_4 = y2 - \frac{y3 + y4}{2};$$

$$\Delta z_4 = z2 - \frac{z3 + z4}{2};$$

where, $\Delta x_4$ is a deviation between the push-out segment and the $N_{+1}$ tube coupling in the x-axis direction; $\Delta y_4$ is a deviation between the push-out segment and the $N_{+1}$ tube coupling in the y-axis direction; and $\Delta z_4$ is a deviation between the push-out segment and the $N_{+1}$ tube coupling in the z-axis direction.

In some embodiments of this application, in the step of installing the $N_{+2}$ tube coupling, a method for calculating the deviation between the $N_{+2}$ tube coupling and the $N_{+3}$ tube coupling is as follows:

$$\Delta x_1 = \frac{x5 + x6}{2} - x0;$$

$$\Delta y_1 = \frac{y5 + y6}{2} - y0;$$

$$\Delta z_1 = \frac{z5 + z6}{2} - z0;$$

where, $\Delta x_1$ is a deviation between the $N_{+2}$ tube coupling and the $N_{+3}$ tube coupling in the x-axis direction; $\Delta y_1$ is a deviation between the $N_{+2}$ tube coupling and the $N_{+3}$ tube coupling in the y-axis direction; and $\Delta z_1$ is a deviation between the $N_{+2}$ tube coupling and the $N_{+3}$ tube coupling in the z-axis direction.

In some embodiments of this application, in the step of installing the $N_{+1}$ tube coupling, a method for calculating the deviation between the $N_{+1}$ tube coupling and the $N_{+2}$ tube coupling is as follows:

$$\Delta x_2 = \frac{x3 + x4}{2} - \frac{x5 + x6}{2};$$

$$\Delta y_2 = \frac{y3 + y4}{2} - \frac{y5 + y6}{2};$$

$$\Delta z_2 = \frac{z3 + z4}{2} - \frac{z5 + z6}{2};$$

where, $\Delta x_2$ is a deviation between the $N_{+1}$ tube coupling and the $N_{+2}$ tube coupling in the x-axis direction; $\Delta y_2$ is a deviation between the $N_{+1}$ tube coupling and the $N_{+2}$ tube coupling in the y-axis direction; and $\Delta z_2$ is a deviation between the $N_{+1}$ tube coupling and the $N_{+2}$ tube coupling in the z-axis direction.

In some embodiments of this application, in the step of pushing out the push-out segment, a method for calculating the deviation between the push-out segment and the $N_{+2}$ tube coupling is as follows:

$$\Delta x_3' = \frac{x1 + x2}{2} - \frac{x5 + x6}{2};$$

$$\Delta y_3' = \frac{y1 + y2}{2} - \frac{y5 + y6}{2};$$

$$\Delta z_3' = \frac{z1 + z2}{2} - \frac{z5 + z6}{2};$$

where, $\Delta x_3'$ is a deviation between the push-out segment and the $N_{+2}$ tube coupling in the x-axis direction; $\Delta y_3'$ is a deviation between the push-out segment and the $N_{+2}$ tube coupling in the y-axis direction; and $\Delta z_3'$ is a deviation between the push-out segment and the $N_{+2}$ tube coupling in the z-axis direction;

a method for calculating the deviation between the push-out segment and the $N_{+1}$ tube coupling is as follows:

$$\Delta x_4' = \frac{x1 + x2}{2} - \frac{x3 + x4}{2};$$

$$\Delta y_4' = \frac{y1 + y2}{2} - \frac{y3 + y4}{2};$$

$$\Delta z_4' = \frac{z1 + z2}{2} - \frac{z3 + z4}{2};$$

where, $\Delta x_4'$ is a deviation between the push-out segment and the $N_{+1}$ tube coupling in the x-axis direction; $\Delta y_4'$ is a deviation between the push-out segment and the $N_{+1}$ tube coupling in the y-axis direction; and $\Delta z_4'$ is a deviation between the push-out segment and the $N_{+1}$ tube coupling in the z-axis direction.

In some embodiments of this application, the method further comprises a step of establishing a second coordinate system: distributing a control point ND at the tail end of the N tube coupling, and establishing the second coordinate system at the tail end of the N tube coupling; the step of distributing feature points further comprises: by taking the control point ND as a reference point, respectively measuring relative positions of the breakthrough points $N_{+1}S$ and $N_{+1}W$ with respect to the control point ND, and converting the relative positions into coordinates of the breakthrough points $N_{+1}S$ and $N_{+1}W$ in the second coordinate system, so as to calculate a deviation between the $N_{+1}$ tube coupling and the N tube coupling.

In some embodiments of this application, the coordinates of the control point ND in the second coordinate system are (x7, y7, z7), and the coordinates of the breakthrough points $N_{+1}S$ and $N_{+1}W$ in the second coordinate system are (x3', y3', z3') and (x4', y4', z4') respectively; in the step of installing the $N_{+1}$ tube coupling, a method for calculating the deviation between the $N_{+1}$ tube coupling and the N tube coupling is as follows:

$$\Delta x_5 = \frac{x3' + x4'}{2} - x7;$$

$$\Delta y_5 = \frac{y3' + y4'}{2} - y7;$$

$$\Delta z_5 = \frac{z3' + z4'}{2} - z7;$$

where, $\Delta x_5$ is a deviation between the $N_{+1}$ tube coupling and the N tube coupling in the x-axis direction: $\Delta y_5$ is a deviation between the $N_{+1}$ tube coupling and the N tube coupling in the y-axis direction; and $\Delta z_5$ is a deviation between the $N_{+1}$ tube coupling and the N tube coupling in the z-axis direction.

In some embodiments of this application, the method further comprises a step of verifying accuracy of the first coordinate system: respectively measuring relative positions of the breakthrough points $N_{+2}S$ and $N_{+2}W$ with respect to the control point ND, and converting the relative positions into coordinates of the breakthrough points $N_{+2}S$ and $N_{+2}W$ in the second coordinate system, calculating a deviation between the $N_{+1}$ tube coupling and the $N_{+2}$ tube coupling by using the second coordinate system, and comparing the deviation between the $N_{+1}$ tube coupling and the $N_{+2}$ tube coupling obtained by using the second coordinate system with the deviation between the $N_{+1}$ tube coupling and the $N_{+2}$ tube coupling obtained by using the first coordinate system, so as to verify the accuracy of the deviation between the $N_{+1}$ tube coupling and the $N_{+2}$ tube coupling calculated by using the first coordinate system.

In some embodiments of this application, the coordinates of the breakthrough points $N_{+2}S$ and $N_{+2}W$ in the second coordinate system are (x5', y5', z5') and (x6', y6', z6') respectively, and in the step of verifying the accuracy of the first coordinate system, a method for calculating the deviation between the $N_{+1}$ tube coupling and the $N_{+2}$ tube coupling by using the second coordinate system is as follows:

$$\Delta x_6 = \frac{x5' + x6'}{2} - \frac{x3' + x4'}{2};$$

$$\Delta y_6 = \frac{y5' + y6'}{2} - \frac{y3' + y4'}{2};$$

$$\Delta z_6 = \frac{z5' + z6'}{2} - \frac{z3' + z4'}{2};$$

where, $\Delta x_6$ is a deviation between the $N_{+1}$ tube coupling and the $N_{+2}$ tube coupling in the x-axis direction in the second coordinate system: $\Delta y_6$ is a deviation between the $N_{+1}$ tube coupling and the $N_{+2}$ tube coupling in the y-axis direction in the second coordinate system; and $\Delta z_6$ is a deviation between the $N_{+1}$ tube coupling and the $N_{+2}$ tube coupling in the z-axis direction in the second coordinate system;

comparing a difference value between $\Delta x_2$ and $\Delta x_6$, a difference value between $\Delta y_2$ and $\Delta y_6$, and a difference value between $\Delta z_2$ and $\Delta z_6$, to verify the accuracy of the deviation between the $N_{+1}$ tube coupling and the $N_{+2}$ tube coupling calculated by using the first coordinate system.

In some embodiments of this application, in the step of establishing the first coordinate system, taking a point o located at the tail end of the $N_{+3}$ tube coupling and a point $o_1$ located at a head end of the $N_{+3}$ tube coupling, and establishing a three-dimensional rectangular coordinate system as the first coordinate system by taking the point o as an origin point of the first coordinate system, taking a straight line where the point o and the point $o_1$ are located as an x axis of the first coordinate system and taking a straight line passing the point o and being perpendicular to a top surface of the $N_{+3}$ tube coupling as a z axis.

In some embodiments of this application, in the step of establishing the first coordinate system, taking a direction from the head end of the $N_{+3}$ tube coupling to the tail end of the $N_{+3}$ tube coupling as a positive direction of the x axis of the first coordinate system; and according to the origin point o, the x axis and the positive direction of the x axis of the first coordinate system, based on a left-hand rule, taking a straight line where a thumb of a left hand is located as a y axis of the first coordinate system, and taking a direction that the thumb of the left hand points to as a positive direction of the y axis of the first coordinate system.

In some embodiments of this application, the step of establishing the second coordinate system comprises: taking a point $o_2$ located at the tail end of the N tube coupling and a point $o_2'$ located at a head end of the N tube coupling, and establishing a three-dimensional rectangular coordinate system as the second coordinate system by taking the point $o_2$ as an origin point of the second coordinate system, taking a straight line where the point $o_2$ and the point $o_2'$ are located as an x axis of the second coordinate system and taking a straight line passing the point $o_2$ and being perpendicular to a top surface of the N tube coupling as a z axis.

Based on the aforementioned technical solution, the installation method for the closure joint of the immersed tunnel in the embodiments of this application can realize precise installing of the closure joint; and the installing steps are simple and easy to operate. By establishing the first coordinate system at the $N_{+3}$ tube coupling, and distributing the breakthrough points $N_{+2}S$ and $N_{+2}W$ respectively at the head end and the tail end of the $N_{+2}$ tube coupling, the deviation between the $N_{+2}$ tube coupling and the $N_{+3}$ tube coupling is calculated by using the coordinates of the breakthrough point $N_{+2}S$ and $N_{+2}W$ in the first coordinate system, so as to guide the installing of the $N_{+2}$ tube coupling: by distributing the breakthrough points $N_{+1}S$ and $N_{+1}W$ at the head end and the tail end of the $N_{+1}$ tube coupling respectively, the deviation between the $N_{+1}$ tube coupling and the $N_{+2}$ tube coupling is calculated by using the coordinates of the breakthrough points $N_{+1}S$ and $N_{+1}W$ in the first coordinate system, so as to guide the installing of the $N_{+1}$ tube coupling; and by distributing the breakthrough points DS and DW at the push-out segment, the deviation between the push-out segment and the $N_{+1}$ tube coupling and the deviation between the push-out segment and the $N_{+2}$ tube coupling are calculated by using the coordinates of the breakthrough points DS and DW in the first coordinate system, so as to allow the push-out segment to be precisely butted with the tail end of the $N_{+2}$ tube coupling.

BRIEF DESCRIPTION OF THE DRAWINGS

The accompanying drawings described herein are to provide a further understanding of the present application and constitute a part of this application. The illustrative embodiments and their descriptions are provided to explain the present application and do not constitute undue limitations on the present application. In the drawings.

In the Drawings.

Figure 1:
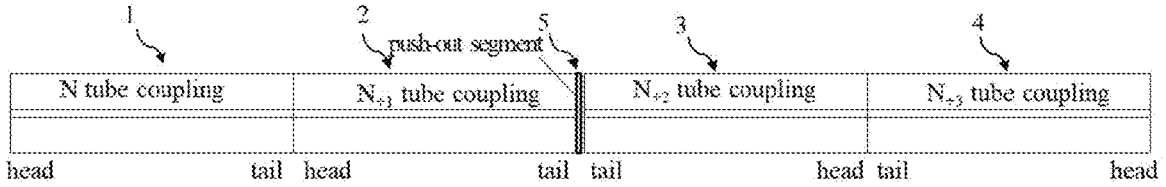
FIG. 1 is a schematic structural diagram when installing a closure joint of an immersed tunnel in the prior art.
Figure 2:
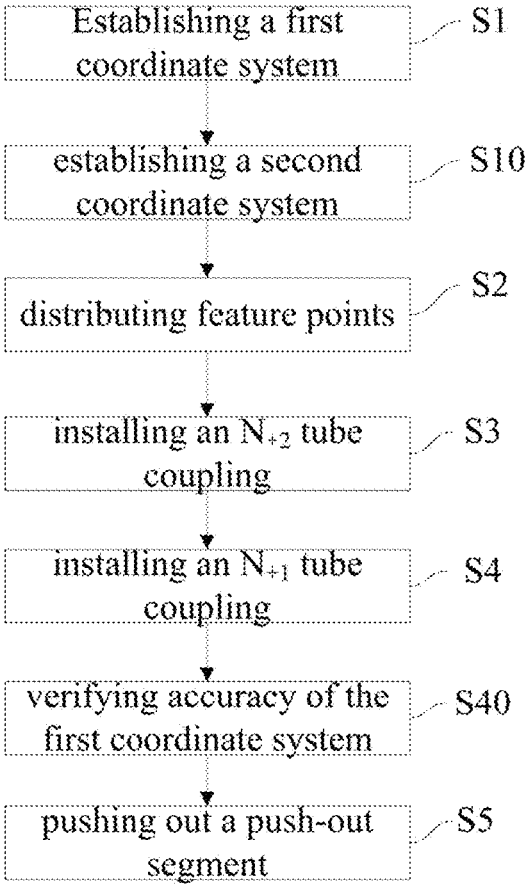
FIG. 2 is a flowchart of an installation method for a closure joint of an immersed tunnel in an embodiment of the present application.

1. N tube coupling; 2. $N_{+1}$ tube coupling; 3. $N_{+2}$ tube coupling; 4. $N_{+3}$ tube coupling; 5. push-out segment.

DETAILED DESCRIPTION

The technical solutions in the embodiments will be clearly and completely described below with reference to the accompanying drawings of the present application. Apparently, embodiments to be described in the specific implementations are only some but not all of the embodiments of the present application. Based on the embodiments of the present application, all other embodiments obtained by a person of ordinary skill in the art without involving any inventive effort shall fall into the protection scope of the present application.

In the description of the present application, it is to be understood that the terms "central", "lateral", "longitudinal", "upper", "lower", "front", "rear", "left", "right", "vertical", "horizontal", "top", "bottom", "inner", "outer" and the like are based on directional or positional relationships as shown in the accompanying drawings, and are only for the purposes of facilitating and simplifying the descriptions, rather than indicating or implying that the referred apparatus or element has to have a specific direction or be constructed and operated in the specific direction, and therefore, they cannot be regarded as limitations on the present application.

Terms "first" and "second" are for descriptive purposes only, and cannot be understood as indicating or implying the relative importance or implicitly indicating the number of indicated technical features. Therefore, features defined as "first" and "second" may explicitly or implicitly comprise one or more of the features.

In the description of the present application, it should be noted that unless otherwise specified and limited, the terms "installed", "linked" and "connected" should be broadly understood, for example, it means that two elements may be fixedly connected, detachably connected or integrally connected: may be directly connected, may be indirectly connected through an intermediate medium, or may be internally communicated. For those skilled in the art, the specific meanings of the above terms in this application can be understood depending on specific situations.

It is worth understanding that the specific order of steps of a method may be shown in the accompanying drawings, but the order of the steps may also be different from the described order. Furthermore, two or more steps can be performed at the same time or partially performed at the same time. All such variations fall within the scope of the present disclosure. In the description of the present application, a "push-out segment" means a "closure joint".

In a construction process of an immersed tunnel, construction is simultaneously performed from both ends in opposite directions, and the closure joint is installed at a final joining position. The installation method for the closure joint of the immersed tunnel in the present application mainly involves installing the closure joint and four tube couplings related to the installation of the closure joint, and the installation methods for the remaining tube couplings are not within the scope of the present application, and may refer to the prior art.

As shown in FIG. 1, an N tube coupling 1 and an $N_{+3}$ tube coupling 4 are respectively at two sides, tail ends of which face each other; an $N_{+1}$ tube coupling 2 is installed at the tail end of the N tube coupling 1; a head end of the $N_{+1}$ tube coupling 2 is connected with the tail end of the N tube coupling 1: an $N_{+2}$ tube coupling 3 is installed at the tail end of the $N_{+3}$ tube coupling 4: a head end of the $N_{+2}$ tube coupling 3 is connected with the tail end of the $N_{+3}$ tube coupling 4: a tail end of the $N_{+1}$ tube coupling 2 faces a tail end of the $N_{+2}$ tube coupling 3, with a gap therebetween: a push-out segment 5 is disposed in the tail end of the $N_{+1}$ tube coupling 2: the push-out segment 5 is pushed out from the $N_{+1}$ tube coupling 2 towards the $N_{+2}$ tube coupling 3 to butt with the $N_{+2}$ tube coupling 3, thereby completing the construction of the immersed tunnel.

As shown in FIGS. 2-6, in an exemplary embodiment, the installation method for the closure joint of the immersed tunnel comprises the steps: S1, establishing a first coordinate system, S2, distributing feature points, S3, installing an $N_{+2}$ tube coupling, S4, installing an $N_{+1}$ tube coupling and S5 pushing out a push-out segment.

In the step of S1 establishing the first coordinate system, the first coordinate system is established at the tail end of the installed $N_{+3}$ tube coupling 4.

Figure 5:
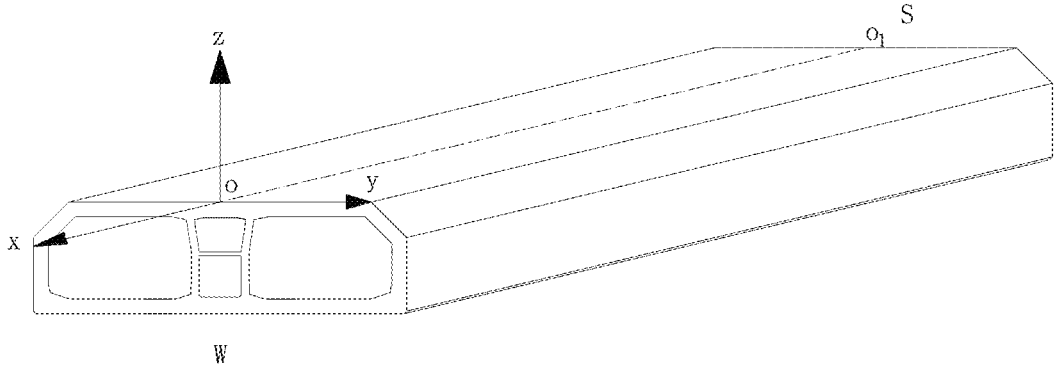
FIG. 5 is a schematic diagram of a first coordinate system established at an $N_{+3}$ tube coupling according to the installation method for the closure joint of the immersed tunnel in the embodiment of the present application.

In some embodiments of S1, as shown in FIG. 5, the first coordinate system is established at the tail end of the $N_{+3}$ tube coupling 4; the first coordinate system is established according to the following method: taking a point o at the tail end of the $N_{+3}$ tube coupling 4 and the point $o_1$ at the head end of the $N_{+3}$ tube coupling 4, and establishing a three-dimensional rectangular coordinate system as the first coordinate system by taking the point o as an origin point of the first coordinate system, taking a straight line where the point o and the point $o_1$ are located as an x axis of the first coordinate system and taking a straight line passing the point o and being perpendicular to a top surface of the $N_{+3}$ tube coupling 4 as a z axis; taking a direction from the head end of the $N_{+3}$ tube coupling 4 to the tail end of the $N_{+3}$ tube coupling 4 as a positive direction of the x axis of the first coordinate system; and according to the origin point o, the x axis and the positive direction of the x axis of the first coordinate system, based on the left-hand rule, taking a straight line where the thumb of the left hand is located as a y axis of the first coordinate system, and taking a direction that the thumb of the left hand points to as a positive direction of the y axis of the first coordinate system. In some embodiments of S1, a control point $N_{+3}D$ is distributed at the tail end of the $N_{+3}$ tube coupling 4, by taking the control point $N_{+3}D$ as a reference point, coordinates of the control point $N_{+3}D$ in the first coordinate system are (x0, y0, z0), and by measuring relative positions of a target point with respect to the control point $N_{+3}D$, a coordinate position of the target point in the first coordinate system is obtained by conversion.

Figure 3:
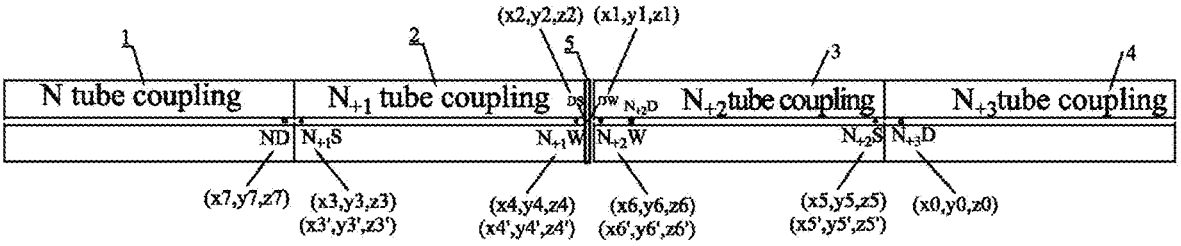
FIG. 3 is a schematic diagram of distribution positions and coordinates of feature points in the installation method for the closure joint of the immersed tunnel in the embodiment of the present application.
Figure 4:
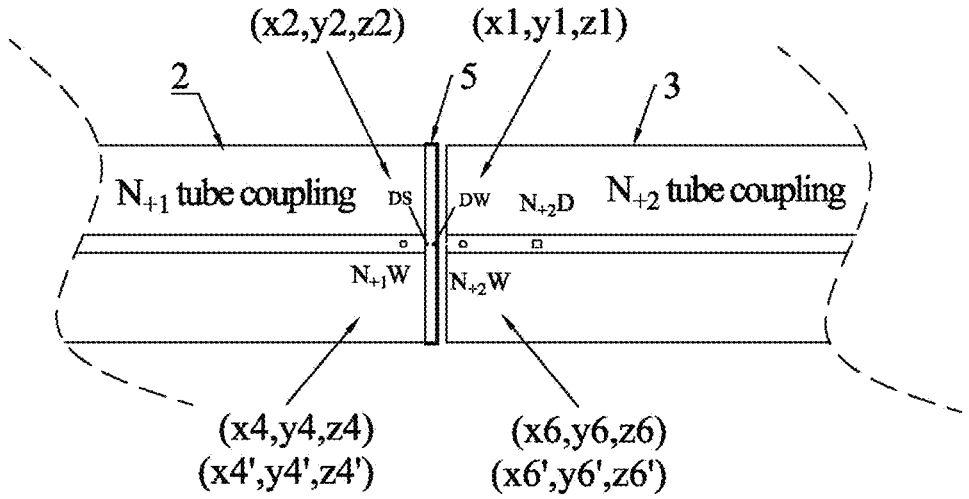
FIG. 4 is a partial enlarged view of a push-out segment in FIG. 3.

In the step of S2 distributing the feature points, as shown in FIG. 3 and FIG. 4, breakthrough points $N_{+1}S$ and $N_{+1}W$ are respectively distributed at the head end and the tail end of the $N_{+1}$ tube coupling 2, breakthrough points DS and DW are respectively distributed at the head end and the tail end of the push-out segment 5, and breakthrough points $N_{+2}S$ and $N_{+2}W$ are respectively distributed at the head end and the tail end of the $N_{+2}$ tube coupling 3; the breakthrough points DS, DW, $N_{+1}S$, $N_{+1}W$, $N_{+2}S$, $N_{+2}W$ are target points in the installation method for the closure joint, and coordinates of the breakthrough points DS, DW, $N_{+1}S$, $N_{+1}W$, $N_{+2}S$, $N_{+2}W$ in the first coordinate system are calculated respectively.

In some embodiments of S2, by measuring relative positions of the breakthrough points DS, DW, $N_{+1}S$, $N_{+1}W$, $N_{+2}S$, $N_{+2}W$ with respect to the control point $N_{+3}D$ respectively, the coordinates of the breakthrough points DS, DW, $N_{+1}S$, $N_{+1}W$, $N_{+2}S$ and $N_{+2}W$ in the first coordinate system can be calculated, where coordinates of the breakthrough point DW in the first coordinate system are (x1, y1, z1), coordinates of the breakthrough point DS in the first coordinate system are (x2, y2, z2), coordinates of the breakthrough point $N_{+1}S$ in the first coordinate system are (x3, y3, z3), coordinates of the breakthrough point $N_{+1}W$ in the first coordinate system are (x4, y4, z4), coordinates of the breakthrough point $N_{+2}S$ in the first coordinate system are (x5, y5, z5) and coordinates of the breakthrough point $N_{+2}W$ in the first coordinate system are (x6, y6, z6).

In the step of S3 installing the $N_{+2}$ tube coupling, a deviation between the $N_{+2}$ tube coupling 3 and the $N_{+3}$ tube coupling 4 is calculated by using the coordinates of the breakthrough points $N_{+2}S$ and $N_{+2}W$ in the first coordinate system, and an installing position of the $N_{+2}$ tube coupling 3 is adjusted according to the calculated deviation between the $N_{+2}$ tube coupling 3 and the $N_{+3}$ tube coupling 4, so that the head end of the $N_{+2}$ tube coupling 3 is precisely butted with the tail end of the $N_{+3}$ tube coupling 4, thereby improving the installing accuracy of the $N_{+2}$ tube coupling 3.

In some embodiments of S3, a method for calculating the deviation between the $N_{+2}$ tube coupling 3 and the $N_{+3}$ tube coupling 4 is as follows:

$$\Delta x_1 = \frac{x5 + x6}{2} - x0;$$

$$\Delta y_1 = \frac{y5 + y6}{2} - y0;$$

$$\Delta z_1 = \frac{z5 + z6}{2} - z0;$$

where, $\Delta x_1$ is a deviation between the $N_{+2}$ tube coupling 3 and the $N_{+3}$ tube coupling 4 in the x-axis direction: $\Delta y_1$ is a deviation between the $N_{+2}$ tube coupling 3 and the $N_{+3}$ tube coupling 4 in the y-axis direction; and $\Delta z_1$ is a deviation between the $N_{+2}$ tube coupling 3 and the $N_{+3}$ tube coupling 4 in the z-axis direction.

In the step of S4 installing the $N_{+1}$ tube coupling, the head end of the $N_{+1}$ tube coupling 2 is precisely butted with the tail end of the installed N tube coupling 1; since the $N_{+1}$ tube coupling 2 needs to be connected with the installed $N_{+2}$ tube coupling 3, if the deviation between the $N_{+1}$ tube coupling 2 and the $N_{+2}$ tube coupling 3 is too large, the $N_{+1}$ tube coupling 2 cannot be precisely butted with the $N_{+2}$ tube coupling 3: accordingly, the deviation between the $N_{+1}$ tube coupling 2 and the $N_{+2}$ tube coupling 3 is calculated by using the coordinates of the breakthrough points $N_{+1}S$ and $N_{+1}W$ in the first coordinate system, to adjust the installing position of the $N_{+1}$ tube coupling 2, so as to ensure that the deviation between the $N_{+1}$ tube coupling 2 and the $N_{+2}$ tube coupling 3 meets the requirement: it should be noted that the tail end of the $N_{+1}$ tube coupling 2 is disposed near the tail end of the $N_{+2}$ tube coupling 3, with a gap therebetween.

In some embodiments of S4, a method for calculating the deviation between the $N_{+1}$ tube coupling 2 and the $N_{+2}$ tube coupling 3 is as follows:

$$\Delta x_2 = \frac{x3 + x4}{2} - \frac{x5 + x6}{2};$$

$$\Delta y_2 = \frac{y3 + y4}{2} - \frac{y5 + y6}{2};$$

$$\Delta z_2 = \frac{z3 + z4}{2} - \frac{z5 + z6}{2};$$

where, $\Delta x_2$ is a deviation between the $N_{+1}$ tube coupling 2 and the $N_{+2}$ tube coupling 3 in the x-axis direction in the first coordinate system: $\Delta y_2$ is a deviation between the $N_{+1}$ tube coupling 2 and the $N_{+2}$ tube coupling 3 in the y-axis direction in the first coordinate system; and $\Delta z_2$ is a deviation between the $N_{+1}$ tube coupling 2 and the $N_{+2}$ tube coupling 3 in the z-axis direction in the first coordinate system.

In the above-mentioned installation method for the closure joint of the immersed tunnel, the push-out segment 5 is disposed in the $N_{+1}$ tube coupling 2 and pushed out from the $N_{+1}$ tube coupling 2 to butt with the tail end of the $N_{+2}$ tube coupling 3 after the $N_{+1}$ tube coupling 2 is installed: it should be noted that when the push-out segment 5 is pushed out, the push-out segment may have a large deviation from the $N_{+1}$ tube coupling 2 or from the $N_{+2}$ tube coupling 3, which will affect the effect of connection between the $N_{+1}$ tube coupling 2 and the $N_{+2}$ tube coupling 3: therefore, in the step of S5 pushing out the push-out segment, the deviation between the push-out segment 5 and the $N_{+1}$ tube coupling 2 and the deviation between the push-out segment and the $N_{+2}$ tube coupling 3 are respectively calculated by using the coordinates of the breakthrough point DS and/or DW in the first coordinate system, to guide the pushing process of the push-out segment 5 disposed inside the $N_{+1}$ tube coupling 2 towards the $N_{+2}$ tube coupling 3, thereby allowing the push-out segment to be precisely butted with the tail end of the $N_{+2}$ tube coupling 3: it should also be noted that when the push-out segment 5 is pushed out, the tail end of the push-out segment 5 is butted with the tail end of the $N_{+2}$ tube coupling 3, and the head end of the push-out segment 5 is still located in the $N_{+1}$ tube coupling 2.

In some embodiments of S5, the deviation between the push-out segment 5 and the $N_{+2}$ tube coupling 3 is calculated by using the coordinates of the breakthrough point DW in the first coordinate system, and the deviation between the push-out segment 5 and the $N_{+1}$ tube coupling 2 is calculated by using the coordinates of the breakthrough point DS in the first coordinate system: specifically, a method for calculating the deviation between the push-out segment 5 and the $N_{+2}$ tube coupling 3 is as follows:

$$\Delta x_3 = x1 - \frac{x5 + x6}{2};$$

$$\Delta y_3 = y1 - \frac{y5 + y6}{2};$$

$$\Delta z_3 = z1 - \frac{z5 + z6}{2};$$

where, $\Delta x_3$ is a deviation between the push-out segment 5 and the $N_{+2}$ tube coupling 3 in the x-axis direction: $\Delta y_3$ is a deviation between the push-out segment 5 and the $N_{+2}$ tube coupling 3 in the y-axis direction; and $\Delta z_3$ is a deviation between the push-out segment 5 and the $N_{+2}$ tube coupling 3 in the z-axis direction;

a method for calculating the deviation between the push-out segment 5 and the $N_{+1}$ tube coupling 2 is as follows:

$$\Delta x_4 = x2 - \frac{x3 + x4}{2};$$

$$\Delta y_4 = y2 - \frac{y3 + y4}{2};$$

$$\Delta z_4 = z2 - \frac{z3 + z4}{2};$$

where, $\Delta x_4$ is a deviation between the push-out segment 5 and the $N_{+1}$ tube coupling 2 in the x-axis direction: $\Delta y_4$ is a deviation between the push-out segment 5 and the $N_{+1}$ tube coupling 2 in the y-axis direction; and $\Delta z_4$ is a deviation between the push-out segment 5 and the $N_{+1}$ tube coupling 2 in the z-axis direction.

In other embodiments of S5, the deviation between the push-out segment 5 and the $N_{+1}$ tube coupling 2 and the deviation between the push-out segment and the $N_{+2}$ tube coupling 3 are respectively calculated by using the coordinates of the breakthrough points DW and DS in the first coordinate system: specifically, a method for calculating the deviation between the push-out segment 5 and the $N_{+2}$ tube coupling 3 is as follows:

$$\Delta x_3' = \frac{x1 + x2}{2} - \frac{x5 + x6}{2};$$

$$\Delta y_3' = \frac{y1 + y2}{2} - \frac{y5 + y6}{2};$$

$$\Delta z_3' = \frac{z1 + z2}{2} - \frac{z5 + z6}{2};$$

where, $\Delta x_3'$ is a deviation between the push-out segment 5 and the $N_{+2}$ tube coupling 3 in the x-axis direction: $\Delta y_3'$ is a deviation between the push-out segment 5 and the $N_{+2}$ tube coupling 3 in the y-axis direction; and $\Delta z_3'$ is a deviation between the push-out segment 5 and the $N_{+2}$ tube coupling 3 in the z-axis direction;

a method for calculating the deviation between the push-out segment 5 and the $N_{+1}$ tube coupling 2 is as follows:

$$\Delta x_4' = \frac{x1 + x2}{2} - \frac{x3 + x4}{2};$$

$$\Delta y_4' = \frac{y1 + y2}{2} - \frac{y3 + y4}{2};$$

$$\Delta z_4' = \frac{z1 + z2}{2} - \frac{z3 + z4}{2};$$

where, $\Delta x_4'$ is a deviation between the push-out segment 5 and the $N_{+1}$ tube coupling 2 in the x-axis direction: $\Delta y_4'$ is a deviation between the push-out segment 5 and the $N_{+1}$ tube coupling 2 in the y-axis direction; and $\Delta z_4'$ is a deviation between the push-out segment 5 and the $N_{+1}$ tube coupling 2 in the z-axis direction.

In actual construction, the $N_{+1}$ tube coupling 2 needs to be installed with reference to the already installed N tube coupling 1: in order to ensure the installing accuracy of the $N_{+1}$ tube coupling 2 and the N tube coupling 1, in some embodiments of the installation method for the closure joint of the immersed tunnel, the method also comprises S10, establishing a second coordinate: distributing a control point ND at the tail end of the N tube coupling 1, and establishing the second coordinate system at the tail end of the N tube coupling 1: in the step of S2 distributing the feature points, by taking the control point ND as a reference point, relative positions of the breakthrough points $N_{+1}S$ and $N_{+1}W$ with respect to the control point ND are measured respectively, and converted into coordinates of the breakthrough points $N_{+1}S$ and $N_{+1}W$ in the second coordinate system, so as to calculate the deviation between the $N_{+1}$ tube coupling 2 and the N tube coupling 1. The deviation between the $N_{+1}$ tube coupling 2 and the N tube coupling 1 is calculated to adjust the installing position of the $N_{+1}$ tube coupling 2.

Figure 6:
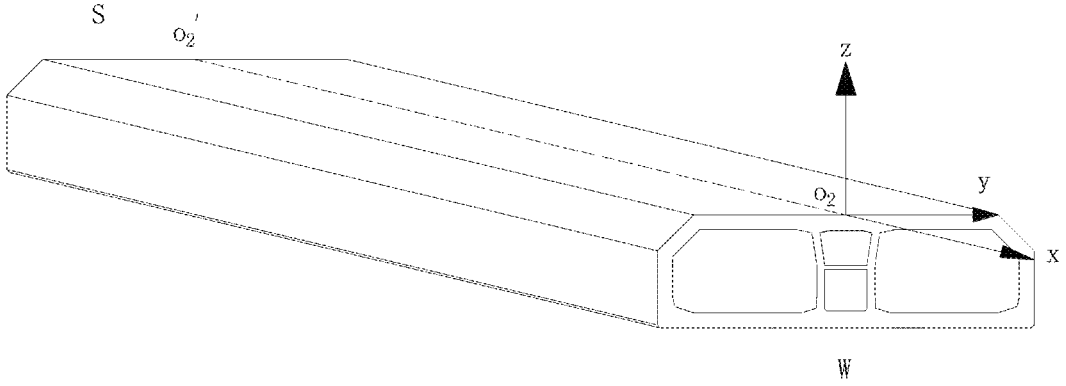
FIG. 6 is a schematic diagram of a second coordinate system established at an N tube coupling according to the installation method for the closure joint of the immersed tunnel in the embodiment of the present application.

In some implementations of S10, as shown in FIG. 6, the steps of establishing the second coordinate system comprises: taking a point $o_2$ at the tail end of the N tube coupling 1 and the point $o_2'$ at the head end of the N tube coupling 1, and establishing a three-dimensional rectangular coordinate system as the second coordinate system by taking the point $o_2$ as an origin point of the second coordinate system, taking a straight line where the point $o_2$ and the point $o_2'$ are located as an x axis of the second coordinate system and taking a straight line passing the point $o_2$ and being perpendicular to a top surface of the N tube coupling as a z axis; taking a direction from the head end of the N tube coupling 1 to the tail end of the N tube coupling 1 as a positive direction of the x axis of the second coordinate system; and according to the origin point $o_2$, the x axis and the positive direction of the x axis of the second coordinate system, based on the left-hand rule, taking a straight line where the thumb of the left hand is located as a y axis of the second coordinate system, and taking a direction that the thumb of the left hand points to as a positive direction of the y axis of the second coordinate system.

In some embodiments of S4 installing the $N_{+1}$ tube coupling, coordinates of the control point ND in the second coordinate system are (x7, y7, z7), and coordinates of the breakthrough points $N_{+1}S$ and $N_{+1}W$ in the second coordinate system are (x3', y3', z3') and (x4', y4', z4') respectively: a method for calculating the deviation between the $N_{+1}$ tube coupling 2 and the N tube coupling 1 is as follows:

$$\Delta x_5 = \frac{x3' + x4'}{2} - x7;$$

$$\Delta y_5 = \frac{y3' + y4'}{2} - y7;$$

$$\Delta z_5 = \frac{z3' + z4'}{2} - z7;$$

where, $\Delta x_5$ is a deviation between the $N_{+1}$ tube coupling 2 and N tube coupling 1 in the x-axis direction: $\Delta y_5$ is a deviation between the $N_{+1}$ tube coupling 2 and the N tube coupling 1 in the y-axis direction; and $\Delta z_5$ is a deviation between the $N_{+1}$ tube coupling 2 and the N tube coupling 1 in the z-axis direction.

In some embodiments of the installation method for the closure joint of the immersed tunnel, the method further comprises S40, verifying the accuracy of the first coordinate system: measuring relative positions of the breakthrough points $N_{+2}S$ and $N_{+2}W$ with respect to the control point ND respectively, converting the relative positions into coordinates of the breakthrough points $N_{+2}S$ and $N_{+2}W$ in the second coordinate system, calculating a deviation between the $N_{+1}$ tube coupling 2 and the $N_{+2}$ tube coupling 3 by using the second coordinate system, and comparing the deviation between the $N_{+1}$ tube coupling 2 and the $N_{+2}$ tube coupling 3 obtained by using the second coordinate system with the deviation between the $N_{+1}$ tube coupling 2 and the $N_{+2}$ tube coupling 3 obtained by using the first coordinate system, to verify the accuracy of the deviation between the $N_{+1}$ tube coupling 2 and the $N_{+2}$ tube coupling 3 calculated by using the first coordinate system.

In some embodiments of S40, the coordinates of the breakthrough points $N_{+2}S$ and $N_{+2}W$ in the second coordinate system are (x5', y5', z5') and (x6', y6', z6') respectively, and a method for calculating the deviation between the $N_{+1}$ tube coupling 2 and the $N_{+2}$ tube coupling 3 by using the second coordinate system is as follows:

$$\Delta x_6 = \frac{x5' + x6'}{2} - \frac{x3' + x4'}{2};$$

$$\Delta y_6 = \frac{y5' + y6'}{2} - \frac{y3' + y4'}{2};$$

-continued $$\Delta z_6 = \frac{z5' + z6'}{2} - \frac{z3' + z4'}{2};$$

where, $\Delta x_6$ is a deviation between the $N_{+1}$ tube coupling 2 and the $N_{+2}$ tube coupling 3 in the x-axis direction in the second coordinate system: $\Delta y_6$ is a deviation between the $N_{+1}$ tube coupling 2 and the $N_{+2}$ tube coupling 3 in the y-axis direction in the second coordinate system; and $\Delta z_6$ is a deviation between the $N_{+1}$ tube coupling 2 and the $N_{+2}$ tube coupling 3 in the z-axis direction in the second coordinate system;

comparing a difference value between $\Delta x_2$ and $\Delta x_6$, a difference value between $\Delta y_2$ and $\Delta y_6$, and a difference value between $\Delta z_2$ and $\Delta z_6$, to verify the accuracy of the deviation between the $N_{+1}$ tube coupling 2 and the $N_{+2}$ tube coupling 3 calculated by using the first coordinate system.

According to the installation method for the closure joint of the immersed tunnel, by establishing the first coordinate system at the $N_{+3}$ tube coupling, and distributing the breakthrough points $N_{+2}S$ and $N_{+2}W$ respectively at the head end and the tail end of the $N_{+2}$ tube coupling, the deviation between the $N_{+2}$ tube coupling and the $N_{+3}$ tube coupling is calculated by using the coordinates of the breakthrough point $N_{+2}S$ and $N_{+2}W$ in the first coordinate system, so as to guide the installing of the $N_{+2}$ tube coupling: by distributing the breakthrough points $N_{+1}S$ and $N_{+1}W$ at the head end and the tail end of the $N_{+1}$ tube coupling respectively, the deviation between the $N_{+1}$ tube coupling and the $N_{+2}$ tube coupling is calculated by using the coordinates of the breakthrough points $N_{+1}S$ and $N_{+1}W$ in the first coordinate system, so as to guide the installing of the $N_{+1}$ tube coupling; and by distributing the breakthrough points DS and DW at the push-out segment, the deviation between the push-out segment and the $N_{+1}$ tube coupling and the deviation between the push-out segment and the $N_{+2}$ tube coupling are calculated by using the coordinates of the breakthrough points DS and DW in the first coordinate system, so as to adjust the pushing direction of the push-out segment, and allow the push-out segment to be precisely butted with the tail end of the $N_{+2}$ tube coupling.

Embodiment 1

The above-mentioned installation method for the closure joint of the immersed tunnel will be described below in detail by taking an example in which coordinates of the control point $N_{+3}D$ in the first coordinate system are (x0, y, z0), coordinates of the breakthrough point DW in the first coordinate system are (x1, y1, z1), coordinates of the breakthrough point DS in the first coordinate system are (x2, y2, z2), coordinates of the breakthrough point $N_{+1}S$ in the first coordinate system are (x3, y3, z3), coordinates of the breakthrough point $N_{+1}W$ in the first coordinate system are (x4, y4, z4), coordinates of the breakthrough point $N_{+2}S$ in the first coordinate system are (x5, y5, z5), coordinates of the breakthrough point $N_{+2}W$ in the first coordinate system are (x6, y6, z6), coordinates of the control point ND in the second coordinate system are (x7, y7, z7), coordinates of the breakthrough point $N_{+1}S$ and NOW in the second coordinate system are (x3', y3', z3') and (x4', y4', z4') respectively. The installation method for the closure joint of the immersed tunnel comprises the following steps:

S1, establishing a first coordinate system: taking a point o at the tail end of the $N_{+3}$ tube coupling 4 and a point $o_1$ at the head end of the $N_{+3}$ tube coupling 4, and establishing a three-dimensional rectangular coordinate system as the first coordinate system by taking the point o as an origin point of the first coordinate system, taking a straight line where the point o and the point $o_1$ are located as an x axis of the first coordinate system and taking a straight line passing the point o and being perpendicular to a top surface of the $N_{+3}$ tube coupling 4 as a z axis; taking a direction from the head end of the $N_{+3}$ tube coupling 4 to the tail end of the $N_{+3}$ tube coupling 4 as a positive direction of the x axis of the first coordinate system; and according to the origin point o, the x axis and the positive direction of the x axis of the first coordinate system, based on the left-hand rule, taking a straight line where the thumb of the left hand is located as a y axis of the first coordinate system, and taking a direction that the thumb of the left hand points to as a positive direction of the y axis of the first coordinate system.

S10, establishing a second coordinate system: taking a point $o_2$ at the tail end of the N tube coupling 1 and the point $o_2'$ at the head end of the N tube coupling 1, and establishing a three-dimensional rectangular coordinate system as the second coordinate system by taking the point $o_2$ as an origin point of the second coordinate system, taking a straight line where the point $o_2$ and the point $o_2'$ are located as an x axis of the second coordinate system and taking a straight line passing the point $o_2$ and being perpendicular to a top surface of the N tube coupling 1 as a z axis; taking a direction from the head end of the N tube coupling 1 to the tail end of the N tube coupling 1 as a positive direction of the x axis of the second coordinate system; and according to the origin point $o_2$, the x axis and the positive direction of the x axis of the second coordinate system, based on the left-hand rule, taking a straight line where the thumb of the left hand is located as a y axis of the second coordinate system, and taking a direction that the thumb of the left hand points to as a positive direction of the y axis of the second coordinate system.

S2, distributing feature points: distributing breakthrough points $N_{+1}S$ and $N_{+1}W$ at the head end and the tail end of the $N_{+1}$ tube coupling 2 respectively, distributing breakthrough points DS and DW at a head end and a tail end of a push-out segment 5 respectively, and distributing breakthrough points $N_{+2}S$ and $N_{+2}W$ at the head end and the tail end of the $N_{+2}$ tube coupling 3 respectively: distributing a control point $N_{+3}D$ at the tail end of the $N_{+3}$ tube coupling 4, and distributing a control point ND at the tail end of the N tube coupling 1; and by taking the control point $N_{+3}D$ as a reference point, coordinates (x1, y1, z1) of the breakthrough point DW in the first coordinate system, coordinates (x2, y2, z2) of the breakthrough point DS in the first coordinate system, coordinates (x3, y3, z3) of the breakthrough point $N_{+1}S$ in the first coordinate system, coordinates (x4, y4, z4) of the breakthrough point $N_{+1}W$ in the first coordinate system, coordinates (x5, y5, z5) of the breakthrough point $N_{+2}S$ in the first coordinate system, and coordinates (x6, y6, z6) of the breakthrough point $N_{+2}W$ in the first coordinate system are obtained, where coordinates of the control point $N_{+3}D$ in the first coordinate system are (x0, y, z0).

S3, installing the $N_{+2}$ tube coupling: calculating deviations $\Delta x_1$, $\Delta y_1$ and $\Delta z_1$ between the $N_{+2}$ tube coupling 3 and the $N_{+3}$ tube coupling 4 by using the coordinates of breakthrough points $N_{+2}S$ and $N_{+2}W$ in the first coordinate system, comparing $\Delta x_1$, $\Delta y_1$ and $\Delta z_1$ with a difference value allowed by actual construction, if $\Delta x_1$, $\Delta y_1$ and $\Delta z_1$ are all within the allowable construction error, it means that the $N_{+2}$ tube coupling 3 is installed in place: if $\Delta x_1$ and/or $\Delta y_1$ and/or $\Delta z_1$ exceed the allowable construction error, adjusting an installing position of the $N_{+2}$ tube coupling 3 until $\Delta x_1$, $\Delta y_1$ and $\Delta z_1$ are all within the allowable construction error, so as to allow the $N_{+2}$ tube coupling 3 to be precisely butted with the $N_{+3}$ tube coupling 4.

S4, installing an $N_{+1}$ tube coupling: immersing the $N_{+1}$ tube coupling 2 to the seabed and allowing the head end of the $N_{+1}$ tube coupling 2 to be precisely butted with the tail end of the installed N tube coupling 1; calculating deviations $\Delta x_5$. $\Delta y_5$ and $\Delta z_5$ between the $N_{+1}$ tube coupling 2 and the N tube coupling 1 by using the second coordinate system, calculating deviations $\Delta x_2$, $\Delta y_2$ and $\Delta z_2$ between the $N_{+1}$ tube coupling 2 and the $N_{+2}$ tube coupling 3 by using coordinates of the first coordinate system, comparing $\Delta x_2$, $\Delta y_2$, $\Delta z_2$, $\rightarrow x_5$, $\Delta y_5$ and $\Delta z_5$ with a difference value allowed by actual construction respectively, if $\Delta x_2$, $\Delta y_2$, $\Delta z_2$, $\Delta x_5$, $\Delta y_5$ and $\Delta z_5$ are all within the allowable construction error, it means that the $N_{+1}$ tube coupling 2 is installed in place: if $\Delta x_2$ and/or $\Delta y_2$ and/or $\Delta z_2$ and/or $\Delta x_5$ and/or $\Delta y_5$ and/or $\Delta z_5$ exceed the allowable construction error, then adjusting an installing position of the $N_{+1}$ tube coupling 2 until $\Delta x_2$, $\Delta y_2$, $\Delta z_2$ and $\Delta x_5$, $\Delta y_5$ and $\Delta z_5$ are all within the allowable construction error, so as to allow the $N_{+1}$ tube coupling 2 to be precisely installed.

S40, verifying the accuracy of the first coordinate system: calculating deviations $\Delta x_6$, $\Delta y_6$ and $\Delta z_6$ between the $N_{+1}$ tube coupling 2 and the $N_{+2}$ tube coupling 3 by using the second coordinate system, and comparing $\Delta x_2$, $\Delta y_2$, $\Delta z_2$ with $\Delta x_6$, $\Delta y_6$, $\Delta z_6$, if difference values between $\Delta x_2$ and $\Delta x_6$, $\Delta y_2$ and $\Delta y_6$, $\Delta z_2$ and $\Delta z_6$ are within the allowable error range, indicating that the accuracy of the first coordinate system is high; if at least one of the difference values between $\Delta x_2$ and $\Delta x_6$, $\Delta y_2$ and $\Delta y_6$, $\Delta z_2$ and $\Delta z_6$ exceeds the allowable error range, indicating that the accuracy of the first coordinate system and/or the second coordinate system are/is low, which means that it is necessary to re-establish the first coordinate system and/or the second coordinate system to ensure the accuracy of the first coordinate system.

S5, pushing out a push-out segment: calculating a deviation between the push-out segment 5 and the $N_{+1}$ tube coupling 2 and a deviation between the push-out segment 5 and the $N_{+2}$ tube coupling 3 respectively by using the coordinates of the breakthrough points DS and DW in the first coordinate system, where the deviation between the push-out segment 5 and the $N_{+2}$ tube coupling 3 is $\Delta x_3$, $\Delta y_3$, $\Delta z_3$, and the deviation between the push-out segment 5 and the $N_{+1}$ tube coupling 2 is $\Delta x_4$, $\Delta y_4$, $\Delta z_4$; comparing $\Delta x_3$, $\Delta y_3$, $\Delta z_3$, $\Delta x_4$, $\Delta y_4$, $\Delta z_4$ with the allowable construction error respectively, and if $\Delta x_3$, $\Delta y_3$, $\Delta z_3$, $\Delta x_4$, $\Delta y_4$, $\Delta z_4$ are all within the allowable error range, pushing out the push-out segment 5 to butt with the tail end of the $N_{+2}$ tube coupling 3: if $\Delta x_3$ and/or $\Delta y_3$ and/or $\Delta z_3$ and/or $\Delta x_4$ and/or $\Delta y_4$ and/or $\Delta z_4$ exceed the allowable error range, adjusting a position of the push-out segment 5 until $\Delta x_3$, $\Delta y_3$, $\Delta z_3$, $\Delta x_4$, $\Delta y_4$, $\Delta z_4$ are all within the allowable error range, so as to allow the push-out segment 5 to be precisely butted with the tail end of the $N_{+2}$ tube coupling 3.

It should be noted that the range of the allowable construction error belongs to the common knowledge in the art, which is omitted here.

According to the installation method for the closure joint of the immersed tunnel, the deviation between the $N_{+2}$ tube coupling and the $N_{+3}$ tube coupling is calculated by using the coordinates of the breakthrough points $N_{+2}S$ and $N_{+2}W$ in the first coordinate system, to adjust the installing position of the $N_{+2}$ tube coupling, so as to ensure that the $N_{+2}$ tube coupling and the $N_{+3}$ tube coupling are precisely installed; the deviation between the $N_{+1}$ tube coupling and the N tube coupling is calculated by using the coordinates of the breakthrough points $N_{+1}S$ and $N_{+1}W$ in the second coordinate system, to adjust the installing position of the $N_{+1}$ tube coupling, so as to ensure that the $N_{+1}$ tube coupling and the N tube coupling are precisely installed: the deviation between the $N_{+1}$ tube coupling and the $N_{+2}$ tube coupling is calculated by using the coordinates of the breakthrough points $N_{+1}S$, $N_{+1}W$, $N_{+2}S$ and $N_{+2}W$ in the first coordinate system, to adjust the installing position of the head end of the $N_{+1}$ tube coupling, so as to ensure that the tail end of the $N_{+1}$ tube coupling and the tail end of the $N_{+2}$ tube coupling are precisely aligned and close to each other, and further allow the push-out segment to be precisely butted with the $N_{+2}$ tube coupling when the push-out segment is pushed out; and by using the coordinates of the breakthrough points DS, DW, $N_{+1}S$, $N_{+1}W$, $N_{+2}S$ and $N_{+2}W$ in the first coordinate system, the deviation between the push-out segment and the $N_{+1}$ tube coupling and the deviation between the push-out segment and $N_{+2}$ tube coupling are calculated to adjust the pushing-out direction of the push-out segment, so as to allow the push-out segment to be precisely butted with the $N_{+2}$ tube coupling.

Finally, it is to be noted that, the embodiments are described progressively in this specification, with each embodiment focusing on the differences from the others, and the identical or similar parts among the embodiments can refer to each other.

The above embodiments are merely used for describing the technical solutions of the present application, rather than limiting the present application. Although the present application has been described in detail by preferred embodiments, it should be understood by a person of ordinary skill in the art that it is possible to make modifications to the specific implementations of the present application or equivalent replacements to some of the technical features without departing from the spirit of the technical solutions of the present application, and these modifications or equivalent replacements shall fall into the scope of the technical solutions sought to be protected by the present application.

The invention claimed is:

1. An installation method for a closure joint of an immersed tunnel, comprising following steps:

establishing a first coordinate system: establishing the first coordinate system at a tail end of an installed $N_{+3}$ tube coupling;

distributing feature points: distributing breakthrough points NHS and $N_{+1}W$ at a head end and a tail end of a $N_{+1}$ tube coupling respectively, distributing breakthrough points DS and DW at a push-out segment, and distributing breakthrough points $N_{+2}S$ and $N_{+2}W$ at a head end and a tail end of a $N_{+2}$ tube coupling respectively; and calculating coordinates of the breakthrough points DS, DW, NHS, $N_{+1}W$, $N_{+2}S$, $N_{+2}W$ in the first coordinate system respectively;

installing the $N_{+2}$ tube coupling: calculating a deviation between the $N_{+2}$ tube coupling and the $N_{+3}$ tube coupling by using the coordinates of the breakthrough points $N_{+2}S$ and $N_{+2}W$ in the first coordinate system, and adjusting an installing position of the $N_{+2}$ tube coupling to make the head end of the $N_{+2}$ tube coupling butt with the tail end of the $N_{+3}$ tube coupling;

installing an $N_{+1}$ tube coupling: butting the head end of the $N_{+1}$ tube coupling with a tail end of an installed N tube coupling: calculating a deviation between the $N_{+1}$ tube coupling and the $N_{+2}$ tube coupling by using the coordinates of the breakthrough points $N_{+1}S$ and $N_{+1}W$ in the first coordinate system, and adjusting an installing position of the $N_{+1}$ tube coupling to make the tail end of the $N_{+1}$ tube coupling close to the tail end of the $N_{+2}$ tube coupling;

pushing out a push-out segment: calculating a deviation between the push-out segment and the $N_{+1}$ tube coupling and a deviation between the push-out segment and the $N_{+2}$ tube coupling respectively by using the coordinates of the breakthrough point DS and/or DW in the first coordinate system, and adjusting a pushing-out direction of the push-out segment disposed inside the $N_{+1}$ tube coupling towards the $N_{+2}$ tube coupling, so as to allow the push-out segment to be precisely butted with the tail end of the $N_{+2}$ tube coupling;

in the step of distributing the feature points, distributing a control point $N_{+3}D$ at the tail end of the $N_{+3}$ tube coupling, by taking the control point $N_{+3}D$ as a reference point, measuring relative positions of the breakthrough points DS, DW, $N_{+1}S$, $N_{+1}W$, $N_{+2}S$, $N_{+2}W$ with respect to the control point $N_{+3}D$ respectively, and converting the relative positions into coordinates in the first coordinate system, where coordinates of the breakthrough point $N_{+3}D$ in the first coordinate system are (x0, y0, z0), coordinates of the breakthrough point DW in the first coordinate system are (x1, y1, z1), coordinates of the breakthrough point DS in the first coordinate system are (x2, y2, z2), coordinates of the breakthrough point $N_{+1}S$ in the first coordinate system are (x3, y3, z3), coordinates of the breakthrough point $N_{+1}W$ in the first coordinate system are (x4, y4, z4), coordinates of the breakthrough point $N_{+2}S$ in the first coordinate system are (x5, y5, z5) and coordinates of the breakthrough point $N_{+2}W$ in the first coordinate system are (x6, y6, z6);

in the step of pushing out the push-out segment, a method for calculating the deviation between the push-out segment and the $N_{+2}$ tube coupling is as follows:

$$\Delta x_3 = x1 - \frac{x5 + x6}{2};$$

$$\Delta y_3 = y1 - \frac{y5 + y6}{2};$$

$$\Delta z_3 = z1 - \frac{z5 + z6}{2};$$

where, $\Delta x_3$ is a deviation between the push-out segment and the $N_{+2}$ tube coupling in the x-axis direction: $\Delta y_3$ is a deviation between the push-out segment and the $N_{+2}$ tube coupling in the y-axis direction; and $\Delta z_3$ is a deviation between the push-out segment and the $N_{+2}$ tube coupling in the z-axis direction;

a method for calculating the deviation between the push-out segment and the $N_{+1}$ tube coupling is as follows:

$$\Delta x_4 - x2 - \frac{x3 + x4}{2};$$

$$\Delta y_4 = y2 - \frac{y3 + y4}{2};$$

$$\Delta z_4 = z2 - \frac{z3 + z4}{z};$$

where, $\Delta x_4$ is a deviation between the push-out segment and the $N_{+1}$ tube coupling in the x-axis direction: $\Delta y_4$ is a deviation between the push-out segment and the $N_{+1}$ tube coupling in the y-axis direction; and $\Delta z_4$ is a deviation between the push-out segment and the $N_{+1}$ tube coupling in the z-axis direction.

2. The installation method for the closure joint of the immersed tunnel according to claim 1, wherein in the step of installing the $N_{+2}$ tube coupling, a method for calculating the deviation between the $N_{+2}$ tube coupling and the $N_{+3}$ tube coupling is as follows:

$$\Delta x_1 - \frac{x5 + x6}{2} - x0;$$

$$\Delta y_1 = \frac{y5 + y6}{2} - y0;$$

$$\Delta z_1 = \frac{z5 + z6}{2} - z0;$$

where, $\Delta x_1$ is a deviation between the $N_{+2}$ tube coupling and the $N_{+3}$ tube coupling in the x-axis direction: $\Delta y_1$ is a deviation between the $N_{+2}$ tube coupling and the $N_{+3}$ tube coupling in the y-axis direction; and $\Delta z_1$ is a deviation between the $N_{+2}$ tube coupling and the $N_{+3}$ tube coupling in the z-axis direction.

3. The installation method for the closure joint of the immersed tunnel according to claim 1, wherein in the step of installing the $N_{+1}$ tube coupling, a method for calculating the deviation between the $N_{+1}$ tube coupling and the $N_{+2}$ tube coupling is as follows:

$$\Delta x_2 = \frac{x3 + x4}{2} - \frac{x5 + x6}{2};$$

$$\Delta y_2 = \frac{y3 + y4}{2} - \frac{y5 + y6}{2};$$

$$\Delta z_2 = \frac{z3 + z4}{2} - \frac{z5 + z6}{2};$$

where, $\Delta x_2$ is a deviation between the $N_{+1}$ tube coupling and the $N_{+2}$ tube coupling in the x-axis direction: $\Delta y_2$ is a deviation between the $N_{+1}$ tube coupling and the $N_{+2}$ tube coupling in the y-axis direction; and $\Delta z_2$ is a deviation between the $N_{+1}$ tube coupling and the $N_{+2}$ tube coupling in the z-axis direction.

4. The installation method for the closure joint of the immersed tunnel according to claim 1, wherein in the step of pushing out the push-out segment, a method for calculating the deviation between the push-out segment and the $N_{+2}$ tube coupling is as follows:

$$\Delta x_3' = \frac{x1 + x2}{2} - \frac{x5 + x6}{2};$$

$$\Delta y_3' = \frac{y1 + y2}{2} - \frac{y5 + y6}{2};$$

$$\Delta z_3' = \frac{z1 + z2}{2} - \frac{z5 + z6}{2};$$

where, $\Delta x_3'$ is a deviation between the push-out segment and the $N_{+2}$ tube coupling in the x-axis direction; $\Delta y_3'$ is a deviation between the push-out segment and the $N_{+2}$ tube coupling in the y-axis direction; and $\Delta z_3'$is a deviation between the push-out segment and the $N_{+2}$ tube coupling in the z-axis direction;

a method for calculating the deviation between the push-out segment and the $N_{+1}$ tube coupling is as follows:

$$\Delta x_4' = \frac{x1 + x2}{2} - \frac{x3 + x4}{2};$$

$$\Delta y_4' = \frac{y1 + y2}{2} - \frac{y3 + y4}{2};$$

$$\Delta z_4' = \frac{z1 + z2}{2} - \frac{z3 + z4}{2};$$

where, $\Delta x_4'$ is a deviation between the push-out segment and the $N_{+1}$ tube coupling in the x-axis direction; $\Delta y_4'$ is a deviation between the push-out segment and the $N_{+1}$ tube coupling in the y-axis direction; and $\Delta z_4'$is a deviation between the push-out segment and the $N_{+1}$ tube coupling in the z-axis direction.

5. The installation method for the closure joint of the immersed tunnel according to claim 1, wherein further comprises a step of establishing a second coordinate system: distributing a control point ND at the tail end of the N tube coupling, and establishing the second coordinate system at the tail end of the N tube coupling: the step of distributing feature points further comprises: by taking the control point ND as a reference point, respectively measuring relative positions of the breakthrough points $N_{+1}S$ and $N_{+1}W$ with respect to the control point ND, and converting the relative positions into coordinates of the breakthrough points $N_{+1}S$ and $N_{+1}W$ in the second coordinate system, so as to calculate a deviation between the $N_{+1}$ tube coupling and the N tube coupling.

6. The installation method for the closure joint of the immersed tunnel according to claim 5, wherein the coordinates of the control point ND in the second coordinate system are (x7, y7, z7), and the coordinates of the breakthrough points $N_{+1}S$ and $N_{+1}W$ in the second coordinate system are (x3', y3', z3') and (x4', y4', z4') respectively; in the step of installing the $N_{+1}$ tube coupling, a method for calculating the deviation between the $N_{+1}$ tube coupling and the N tube coupling is as follows:

$$\Delta x_5 = \frac{x3' + x4'}{2} - x7;$$

$$\Delta y_5 = \frac{y3' + y4'}{2} - y7;$$

$$\Delta z_5 = \frac{z3' + z4'}{2} - z7;$$

where, $\Delta x_5$ is a deviation between the $N_{+1}$ tube coupling and the N tube coupling in the x-axis direction: $\Delta y_5$ is a deviation between the $N_{+1}$ tube coupling and the N tube coupling in the y-axis direction; and $\Delta z_5$ is a deviation between the $N_{+1}$ tube coupling and the N tube coupling in the z-axis direction.

7. The installation method for the closure joint of the immersed tunnel according to claim 6, wherein further comprises a step of verifying accuracy of the first coordinate system: respectively measuring relative positions of the breakthrough points $N_{+2}S$ and $N_{+2}W$ with respect to the control point ND, and converting the relative positions into coordinates of the breakthrough points $N_{+2}S$ and $N_{+2}W$ in the second coordinate system, calculating a deviation between the $N_{+1}$ tube coupling and the $N_{+2}$ tube coupling by using the second coordinate system, and comparing the deviation between the $N_{+1}$ tube coupling and the $N_{+2}$ tube coupling obtained by using the second coordinate system with the deviation between the $N_{+1}$ tube coupling and the $N_{+2}$ tube coupling obtained by using the first coordinate system, so as to verify the accuracy of the deviation between the $N_{+1}$ tube coupling and the $N_{+2}$ tube coupling calculated by using the first coordinate system.

8. The installation method for the closure joint of the immersed tunnel according to claim 7, wherein the coordinates of the breakthrough points $N_{+2}S$ and $N_{+2}W$ in the second coordinate system are (x5', y5', z5') and (x6', y6', z6') respectively, and in the step of verifying the accuracy of the first coordinate system, a method for calculating the deviation between the $N_{+1}$ tube coupling and the $N_{+2}$ tube coupling by using the second coordinate system is as follows:

$$\Delta x_6 = \frac{x5' + x6'}{2} - \frac{x3' + x4'}{2};$$

$$\Delta y_6 = \frac{y5' + y6'}{2} - \frac{y3' + y4'}{2};$$

$$\Delta z_6 = \frac{z5' + z6'}{2} - \frac{z3' + z4'}{2};$$

where, $\Delta x_6$ is a deviation between the $N_{+1}$ tube coupling and the $N_{+2}$ tube coupling in the x-axis direction in the second coordinate system: $\Delta y_6$ is a deviation between the $N_{+1}$ tube coupling and the $N_{+2}$ tube coupling in the y-axis direction in the second coordinate system; and $\Delta z_6$ is a deviation between the $N_{+1}$ tube coupling and the $N_{+2}$ tube coupling in the z-axis direction in the second coordinate system;

comparing a difference value between $\Delta x_2$ and $\Delta x_6$, a difference value between $\Delta y_2$ and $\Delta y_6$, and a difference value between $\Delta z_2$ and $\Delta z_6$, to verify the accuracy of the deviation between the $N_{+1}$ tube coupling and the $N_{+2}$ tube coupling calculated by using the first coordinate system.

9. The installation method for the closure joint of the immersed tunnel according to claim 5, wherein the step of establishing the second coordinate system comprises: taking a point $o_2$ located at the tail end of the N tube coupling and a point $o_2'$ located at a head end of the N tube coupling, and establishing a three-dimensional rectangular coordinate system as the second coordinate system by taking the point $o_2$ as an origin point of the second coordinate system, taking a straight line where the point $o_2$ and the point $o_2'$ are located as an x axis of the second coordinate system and taking a straight line passing the point $o_2$ and being perpendicular to a top surface of the N tube coupling as a z axis.

10. The installation method for the closure joint of the immersed tunnel according to claim 1, wherein in the step of establishing the first coordinate system, taking a point o located at the tail end of the $N_{+3}$ tube coupling and a point $o_1$ located at a head end of the $N_{+3}$ tube coupling, and establishing a three-dimensional rectangular coordinate system as the first coordinate system by taking the point o as an origin point of the first coordinate system, taking a straight line where the point o and the point $o_1$ are located as an x axis of the first coordinate system and taking a straight line passing the point o and being perpendicular to a top surface of the $N_{+3}$ tube coupling as a z axis.

11. The installation method for the closure joint of the immersed tunnel according to claim 10, wherein in the step of establishing the first coordinate system, taking a direction from the head end of the $N_{+3}$ tube coupling to the tail end of the $N_{+3}$ tube coupling as a positive direction of the x axis of the first coordinate system; and according to the origin point o, the x axis and the positive direction of the x axis of the first coordinate system, based on a left-hand rule, taking a straight line where a thumb of a left hand is located as a y axis of the first coordinate system, and taking a direction that the thumb of the left hand points to as a positive direction of the y axis of the first coordinate system.

* * * * *